US012760617B1

(12) United States Patent
Alharith et al.

(10) Patent No.: US 12,760,617 B1
(45) Date of Patent: Oct. 13, 2026

(54) REDUCING LASER ENERGY USAGE IN SANDSTONE CONSOLIDATION

(71) Applicant: Saudi Arabian Oil Company, Dhahran (SA)

(72) Inventors: Abdullah M. Alharith, Al Khobar (SA); Ahmed I. Asiri, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/261,129

(22) Filed: Jul. 7, 2025

(51) Int. Cl.
*E21B 33/138* (2006.01)
*E21B 36/04* (2006.01)

(52) U.S. Cl.
CPC ..... *E21B 33/138* (2013.01); *E21B 36/04* (2013.01)

(58) Field of Classification Search
CPC ..... E21B 33/138; E21B 36/04
See application file for complete search history.

(56) References Cited

U.S. PATENT DOCUMENTS

2014/0262249 A1* 9/2014 Willberg ..... E21B 43/247 166/259
2023/0407707 A1* 12/2023 Batarseh ..... E21B 7/14
2023/0407724 A1 12/2023 Batarseh

FOREIGN PATENT DOCUMENTS

WO 2023250009 A1 12/2023

OTHER PUBLICATIONS

Notification of Transmittal of the International Search Report and the Written Opinion of the International Searching Authority, or the Declaration dated Mar. 9, 2026 pertaining to International application No. PCT/US2025/046581 filed Sep. 16, 2025, pp. 1-15.

* cited by examiner

*Primary Examiner* — Crystal J Lee
(74) *Attorney, Agent, or Firm* — DINSMORE & SHOHL LLP

(57) ABSTRACT

To reduce laser energy usage in sandstone consolidation, an additive material is flowed to a portion of the sandstone formation to be treated. The additive material is configured to reduce a melting point of the formation upon contacting the formation. A laser beam is directed on the portion of the formation after the additive material has contacted the portion of the formation. The laser beam increases a temperature of the formation to less than the reduced melting point of the formation. The laser beam melts the portion of the formation at less than the reduced melting point in response to the additive material contacting the portion of the formation before the laser beam increases the temperature of the formation.

17 Claims, 2 Drawing Sheets

REDUCING LASER ENERGY USAGE IN SANDSTONE CONSOLIDATION

TECHNICAL FIELD

This disclosure relates to consolidation of hydrocarbon-bearing formations, particularly, sandstone consolidation.

BACKGROUND

Sandstone formations play a significant role in hydrocarbon production due to their unique properties and widespread occurrence. These sedimentary rock formations, composed predominantly of sand-sized mineral particles or rock fragments, serve as excellent reservoirs for hydrocarbons such as oil and natural gas. The porosity and permeability of sandstone make it an ideal medium for storing and transmitting these valuable resources. Effective hydrocarbon extraction from sandstone reservoirs necessitates advanced techniques in geological surveying, reservoir modeling, and enhanced recovery methods to address these challenges and optimize production efficiency.

Laser technology is applicable in hydrocarbon production and wellbore operations through the application of high-precision, high-energy laser beams to efficiently and selectively target specific geological formations. Implementations of method can involve deploying laser systems capable of penetrating subsurface formations, thereby creating precise wellbores and enhancing the fracture network within the reservoir. The employment of lasers in these operations would reduce mechanical wear on drilling equipment, minimize environmental disturbances, and provide access to otherwise challenging or marginal reservoirs. Moreover, lasers can facilitate the reconditioning of existing wellbores by vaporizing blockages and deposits, thus potentially restoring and improving the flow pathways for hydrocarbons. The adaptability of laser technology can enable precise calibration and control, tailoring treatments to the specific geological conditions encountered, which in turn can optimize hydrocarbon recovery rates, lowers operational costs, and mitigates environmental impacts. This approach would represent a significant advancement over conventional mechanical drilling and completion techniques, offering a more efficient and sustainable solution for the hydrocarbon industry.

SUMMARY

This specification describes technologies relating to reduced laser usage in sandstone consolidation.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Sandstone consolidation in hydrocarbon production refers to the stabilization and strengthening of sandstone reservoirs to improve their ability to store and transmit oil and gas effectively. This process involves using chemical agents, thermal treatments, or mechanical methods to bind sand grains together, enhancing the reservoir's structural integrity. Sandstone consolidation addresses challenges like sand production and variations in porosity, ultimately optimizing hydrocarbon recovery, reducing operational costs, and minimizing environmental impact. One technique for sandstone consolidation is through the application of heat, for example, using lasers. In addition, heat generated by the lasers can also be used to seal unwanted production zones in the sandstone formation, e.g., water production zones.

The application of laser energy in sandstone consolidation and melting is a precise and controlled process. Typically, the energy required to melt sandstone formations ranges from approximately 300 to 500 watts per square centimeter, depending on the specific mineral composition and the presence of any impurities within the formation. This high-intensity laser energy is directed at the sandstone to achieve the necessary temperature for melting, which is usually around 1,200 degrees Celsius. Specifically, sandstone starts melting upon heating to 1,000 degrees Celsius and completely melts between 1,400 and 1,700 degrees Celsius based on the geological composition of sandstone rock. By fine-tuning the laser parameters, such as the wavelength and pulse duration, operators can optimize the melting process for various geological conditions, ensuring efficient sandstone consolidation and enhanced hydrocarbon recovery.

This disclosure describes systems and methods of treating a formation (e.g., a sandstone formation) using a laser. The formation is part of a subterranean zone, which can include the formation, multiple formations or portion of the formation. In some implementations, an additive material is flowed to a portion of the formation to be treated. The additive material, upon contacting the portion of the formation, is formulated to reduce the melting point of the formation. After applying the additive material, a laser beam is directed onto the portion of the formation. The energy from the laser beam raises the temperature of the formation. In the presence of the additive, the formation melts at a temperature that is below the melting point of the formation. Consequently, the energy used by the laser to melt the formation is reduced. The formation can be melted for consolidate or to seal unwanted zones, e.g., water zones.

Figure 1:
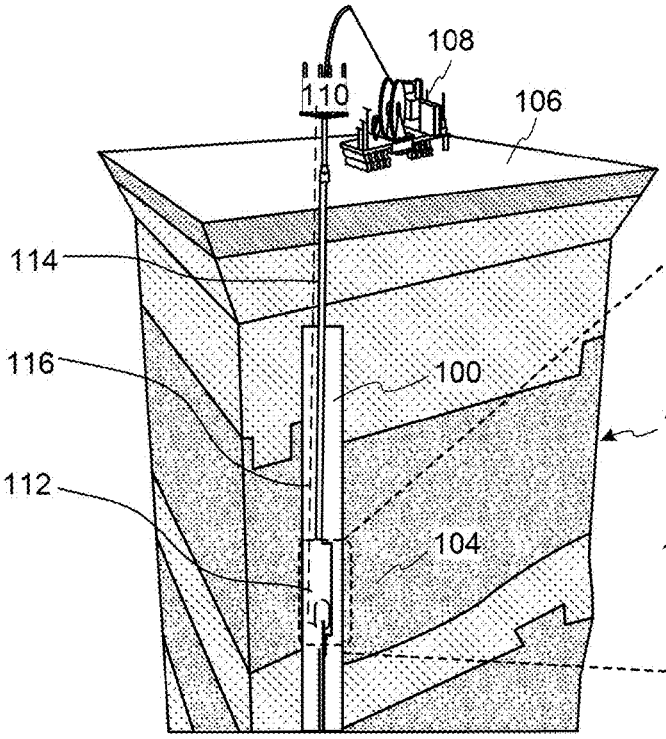
FIG. 1 is a schematic of a wellbore drilled in a subterranean zone.

FIG. 1 is a schematic of a wellbore 100 drilled in a subterranean zone. The wellbore 100 is drilled through a subterranean zone 102 that includes a formation 104, e.g., a sandstone formation. To drill the wellbore 100, a drilling rig is set up at a surface 106 of the subterranean zone 102. The drilling rig can include components such as the derrick, rotary table, drill pipe, and drill bit. The drill bit, typically made of tungsten carbide or diamond, is rotated by the rotary table to penetrate the earth's crust. As the bit grinds through the rock layers, drilling mud is circulated through the drill pipe to the wellbore. This mud serves multiple functions: it transports rock cuttings to the surface, cools the drill bit, stabilizes the wellbore walls, and controls formation pressures to prevent blowouts. As the drilling progresses deeper into the subterranean zone 102, various sections of the wellbore may be secured with steel casing to reinforce the structure and isolate different geological formations. The casing strings are installed sequentially, with each string cemented in place using a cementing unit to create a secure seal that prevents fluid migration between formations and into the wellbore. Techniques, such as Measurement While Drilling (MWD) and Logging While Drilling (LWD), are utilized to provide real-time data on the subsurface conditions, allowing for precise adjustments to the drilling parameters. Directional drilling techniques can be employed to steer the drill bit along a predetermined path, targeting specific reservoirs with accuracy. Upon reaching the desired depth, the wellbore is completed by installing production tubing, packers, and other equipment necessary for hydrocarbon extraction. The wellhead, equipped with blowout preventers (BOPs), is installed at the surface to control the flow of oil and gas from the well and ensure operational safety.

In some implementations, a portion of the formation may need consolidation as part of optimizing wellbore operations. Alternatively or in addition, the wellbore may pass through an unwanted zone, e.g., a water zone, that needs sealing. In such implementations, the techniques described in this disclosure can be implemented to consolidate the formation or seal the unwanted zone.

To do so, surface equipment 108 can be positioned at an entrance to the wellbore 102. The surface equipment 108 can include or be connected to a laser generator 110 that can generate a laser beam having properties sufficient to heat portions of the formation to or above the melting point of those portions. The surface equipment 108 can be connected to a downhole tool 112 that can be raised or lowered within the wellbore using coiled tubing 114 (or wireline or slickline) that is connected to the surface equipment 108 at the surface. The downhole end of the coiled tubing 114 can be connected to the downhole tool 112, which can include optical equipment to receive the laser beam generated by the laser generator 110 and to transmit the laser beam onto a portion of the formation 104. The optical equipment can include, for example, lenses, prisms, mirrors and similar optical equipment that can be used to form, focus and direct the laser beam. In some implementations, a laser transmitter 116 (e.g., a fiber optic cable) is connected at the surface to the laser generator 110. The laser transmitter 116 is run through the wellbore 100 and connected, at its downhole end, to the downhole tool 112. The laser transmitter transmits (or carries) the laser beam generated by the laser generator 110 to the downhole tool 112. The optical equipment in the downhole tool 112 transmit the laser beam onto the portion of the formation 104. The laser transmitter 116 can be positioned within or outside but adjacent to the coiled tubing 114. In general, the laser transmitter 116 can be constructed and positioned such that the structural integrity of the laser transmitter 116 is protected to minimize any leakage or loss of power of the laser beam. The laser transmitter 116 can further be constructed to withstand downhole environments and to fluidically isolate the flow path of the laser beam from external elements.

In some implementations, the surface equipment 108 can also include a reservoir for additive materials that can be flowed into the wellbore 100. The surface equipment 108 can additionally include one or more reservoirs to carry base fluids into the wellbore 100. The additive materials can be mixed with the base fluid and flowed into the wellbore, e.g., via the coiled tubing 114. In some implementations, the additive materials can be powder that can be injected into the base fluid (e.g., nitrogen, water or a combination of them). The powder may be dissolvable in the base fluid. Alternatively, the powder can be flowed with the base fluid as a slurry. In some implementations, the additive materials can be flowed as fine powder without the use of a base fluid as a carrier. To flow the additive materials/base fluid mixture, the surface equipment 108 can include pumps, flow pipes, valves, and other flow equipment. The downhole end of the coiled tubing 114 is positioned at the depth of the portion of the formation 104 to be treated for consolidation or sealing. The downhole tool 112 can include spraying equipment, for example, spraying nozzles, that can spray the additive materials carried by the base fluid on the portion of the formation 104.

Figure 2:
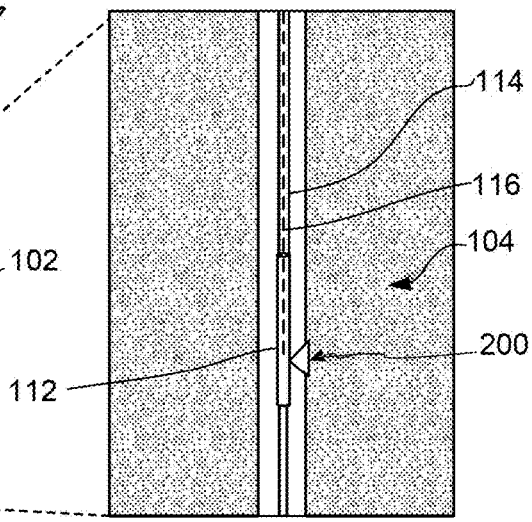
FIG. 2 is a schematic of a portion of a formation in the subterranean zone being treated.

FIG. 2 is a schematic of a portion of a formation 104 in the subterranean zone being treated. As a first step, the portion of the formation 104 has been pre-treated with additive materials that are configured to reduce a melting point of the portion of the formation 104. For example, for sandstone formation, the additive material include potassium carbonate, calcium carbonate, potassium oxide, sodium carbonate, potassium nitrate, or any combination thereof. As described earlier, the surface equipment 108 (FIG. 1) can be operated to flow the additive materials (e.g., in a base fluid) to the portion of the formation 104. In some implementations, the coiled tubing 114 can be operated to both flow the additive material and lower (or raise) the downhole tool 112 across the depth of the portion of the formation 104 to be treated. As the coiled tubing 114 moves the downhole tool 112 across the portion of the formation 104, the downhole tool 112 sprays the additive materials onto the portion of the formation 104. By doing so, the additive materials are placed in contact with the portion of the formation 104. In some instances, the additive materials 104 can at least partially fill the pores in the formation 104.

After the additive materials have been applied onto the portion of the formation 104, the laser generator 110 (FIG. 1) is activated to generate the laser beam. The laser transmitter 116 (e.g., the fiber optic cable) carries the laser beam from the laser generator 110 downhole towards the downhole tool 112. The optical equipment in the downhole tool 112 (FIG. 1) transmit the laser beam onto the portion of the formation 104 that has been contacted by the additive materials. The laser beam 200 can be applied at a focused point or a wide area on the portion of the formation 104. Applying the laser beam 200 can include focusing the laser beam onto a small area on the formation or expanding the laser beam onto a larger area on the target formation. The downhole tool 112 can be rotated up to 360 degrees to apply the laser beam to radial portions of the formation. At the same time, the downhole tool 112 can be moved up/down within the wellbore, e.g., using the coiled tubing, based on the interval depth across which the laser beam 200 is to be applied. The properties of the laser beam are such heat is generated on portion of the formation 104 on which the laser beam is incident. The additive materials, having contacted the portion of the formation 104, have reduced a melting point of the portion of the formation 104 to a reduced melting point, e.g., up to 30% of the untreated melting point. When the temperature on the portion of the formation 104 on which the laser beam is incident increases to the reduced melting point, the portion of the formation 104 begins to melt and consolidate. Upon consolidation, the laser generator 110 can be shut down. In this manner, formation consolidation is implemented using reduced laser energy. That is, if the portion of the formation 104 had not been treated with the additive materials, then the laser generator 110 would need to be operated for a longer duration and/or generate a laser beam with higher power to raise the temperature of the portion of the formation 104 to its melting point. By lowering the melting point of the portion of the formation 104 using the additive materials, the energy required to operate the laser generator 110 for a longer duration or to generate a laser beam of higher power is reduced.

Figure 3:
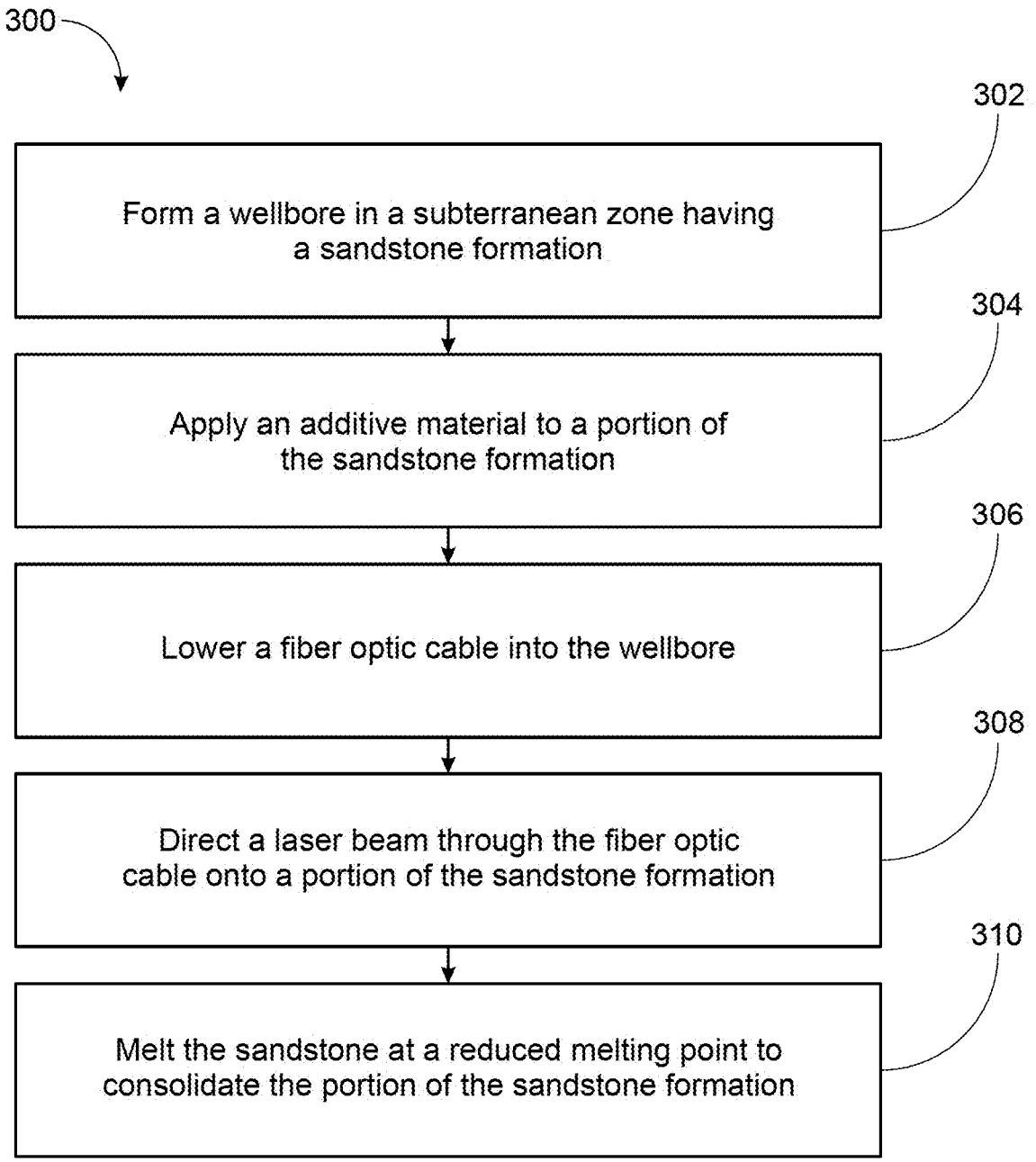
FIG. 3 is a flowchart of an example of a process of treating a portion of a formation in the subterranean zone.

FIG. 3 is a flowchart of an example of a process of treating a portion of a formation in the subterranean zone. The process can be performed by a well operator using, for example, the systems and equipment described earlier with reference to FIGS. 1 and 2. At 302, a wellbore is formed in a subterranean zone that includes a sandstone formation. Doing so involves drilling into the subsurface to access the targeted formation. At 304, an additive material is applied to a portion of the sandstone formation. The additive material is configured to reduce the melting point of the sandstone formation upon contacting the portion of the sandstone formation. At 306, a laser transmitter (e.g., a fiber optic cable) is lowered into the wellbore, positions the equipment at the required depth to deliver the laser treatment. At 308, a laser beam transmitted through the laser transmitter is directed onto the portion of the sandstone formation. The laser beam melts the portion of the sandstone formation at a reduced melting point of the sandstone formation in response to being contacted by the additive material. In doing so, the process of consolidation or sealing the formation is implemented.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, "weight percent" (wt %) can be considered a mass fraction or a mass ratio of a substance to the total mixture or composition. Weight percent can be a weight-to-weight ratio or mass-to-mass ratio, unless indicated otherwise.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

EXAMPLES

Certain aspects of the subject matter described here can be implemented as a method of treating a formation using a laser. An additive material is flowed to a portion of the formation to be treated. The additive material is configured to reduce a melting point of the formation upon contacting the formation. A laser beam is directed on the portion of the formation after the additive material has contacted the portion of the formation. The laser beam increases a temperature of the formation to less than the reduced melting point of the formation. The laser beam melts the portion of the formation at less than the reduced melting point in response to the additive material contacting the portion of the formation before the laser beam increases the temperature of the formation.

An aspect combinable with any other aspect includes the following features. To flow the additive material, a wellbore is formed in the formation at least to a depth of the portion of the formation to be treated. The additive material is flowed into the wellbore.

An aspect combinable with any other aspect includes the following features. To flow the additive material, potassium carbonate, calcium carbonate, potassium oxide, sodium carbonate, potassium nitrate or any combination thereof is flowed.

An aspect combinable with any other aspect includes the following features. The additive material is mixed with the base fluid. A mixture of the additive material and the base fluid is flowed to the portion of the formation.

And aspect combinable with any other aspect includes the following features. The base fluid includes nitrogen, water or a combination of nitrogen and water.

An aspect combinable with any other aspect includes the following features. To direct the laser beam, the laser beam is directed on the portion of the formation using a fiber optic cable run into the wellbore.

An aspect combinable with any other aspect includes the following features. To direct the laser beam using the fiber optic cable, the laser beam is generated at a surface of the wellbore, and transmitted from the surface of the well board to the portion of the formation through the fiber optic cable.

Certain aspects of the subject matter described here can be implemented as a method of treating a formation using a laser. A wellbore is formed in a subterranean zone that includes a sandstone formation. An additive material is applied to a portion of the sandstone formation. The additive material is configured to reduce a melting point of the sandstone formation upon contacting the portion of the sandstone formation. A laser transmitter is lowered into the wellbore. A laser beam transmitted through the laser transmitter is directed onto the portion of the sandstone formation. The laser beam melts deep portion of the sandstone formation at a reduced melting point of the sandstone formation in response to being contacted by the additive material.

An aspect combinable with any other aspect includes the following features. To apply the additive material to the portion of the sandstone formation, the additive material is flowed into the wellbore.

An aspect combinable with any other aspect includes the following features. To flow the additive material, potassium carbonate, calcium carbonate, potassium oxide, sodium carbonate, potassium nitrate or any combination thereof is flowed.

An aspect combinable with any other aspect includes the following features. The additive material is mixed with a base fluid. A mixture of the additive material and the base fluid is flowed to the portion of the sandstone formation.

An aspect combinable with any other aspect includes the following features. The base fluid includes nitrogen, water or a combination of nitrogen and water.

An aspect combinable with any other aspect includes the following features. The laser transmitter includes a fiber optic cable run into the wellbore.

And aspect combinable with any other aspect includes the following features. To direct the laser beam transmitted by the fiber optic cable, the laser beam is generated at a surface of the well bore, and the laser beam is transmitted from the surface of the well bore to the portion of the sandstone formation through the fiber optic cable.

Certain aspects of the subject matter described here can be implemented as a system for treating a formation using a laser. The system includes A wellbore drilling assembly configured to drill a well bore in a subterranean zone including a sandstone formation. The system includes an additive material configured to reduce a melting point of the sandstone formation upon contacting a portion of the sandstone formation. The system includes flow equipment configured to flow the additive material through the wallboard to the portion of the sandstone formation. The system includes a laser transmitter configured to be lowered into the well bore. The laser transmitter is configured to transmit a laser beam onto the portion of the sandstone formation. The laser beam is configured to melt the portion of the sandstone formation at a reduced melting point responsive to the additive material contacting the portion of the sandstone formation.

An aspect combinable with any other aspect includes the following features. The additive material includes potassium carbonate, calcium carbonate, potassium oxide, sodium carbonate, potassium nitrate or any combination thereof.

An aspect combinable with any other aspect includes the following features. The system includes a base fluid configured to carry the additive material through the well bore to the portion of the sandstone formation.

An aspect combinable with any other aspect includes the following features. The base fluid includes nitrogen, water or a combination of nitrogen and water.

An aspect combinable with any other aspect includes the following features. The laser transmitter includes a fiber optic cable run into the wellbore.

An aspect combinable with any other aspect includes the following features. The system includes a laser assembly configured to generate the laser beam at a surface of the wellbore. The fiber optic cable is connected to the laser assembly.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

The invention claimed is:

1. A method of treating a formation using a laser, the method comprising:

flowing an additive material to a portion of the formation to be treated, wherein the additive material is configured to reduce a melting point of the formation upon contacting the portion of the formation, wherein the additive comprises potassium carbonate, calcium carbonate, potassium oxide, sodium carbonate, potassium nitrate or any combination thereof; and directing a laser beam on the portion of the formation after the additive material has contacted the portion of the formation, wherein the laser beam increases a temperature of the formation to less than the reduced melting point of the formation, wherein the laser beam melts the portion of the formation at less than the reduced melting point in response to the additive material contacting the portion of the formation before the laser beam increases the temperature of the formation.

2. The method of claim 1, wherein flowing the additive material comprises:

forming a wellbore in the formation at least to a depth of the portion of the formation to be treated; and flowing the additive material into the wellbore.

3. The method of claim 2, wherein flowing the additive material comprises:

mixing the additive material with a base fluid; and flowing a mixture of the additive material and the base fluid to the portion of the formation.

4. The method of claim 3, wherein the base fluid comprises nitrogen, water or a combination of nitrogen and water.

5. The method of claim 2, wherein directing the laser beam comprises directing the laser beam on the portion of the formation using a fiber optic cable run into the wellbore.

6. The method of claim 5, wherein directing the laser beam using the fiber optic cable comprises:

generating the laser beam at a surface of the wellbore; and transmitting the laser beam from the surface of the wellbore to the portion of the formation through the fiber optic cable.

7. A method of treating a formation using a laser, the method comprising:

forming a wellbore in a subterranean zone comprising a sandstone formation;

applying an additive material to a portion of the sandstone formation, wherein the additive material is configured to reduce a melting point of the sandstone formation upon contacting the portion of the sandstone formation, wherein the additive material comprises potassium carbonate, calcium carbonate, potassium oxide, sodium carbonate, potassium nitrate or any combination thereof;

lowering a laser transmitter into the wellbore; and directing a laser beam transmitted through the laser transmitter onto the portion of the sandstone formation, wherein the laser beam melts the portion of the sandstone formation at a reduced melting point of the sandstone formation in response to being contacted by the additive material.

8. The method of claim 7, wherein applying the additive material to the portion of the sandstone formation comprises flowing the additive material into the wellbore.

9. The method of claim 8, wherein flowing the additive material comprises:

mixing the additive material with a base fluid; and flowing a mixture of the additive material and the base fluid to the portion of the sandstone formation.

10. The method of claim 9, wherein the base fluid comprises nitrogen, water or a combination of nitrogen and water.

11. The method of claim 7, wherein the laser transmitter comprises a fiber optic cable run into the wellbore.

12. The method of claim 11, wherein directing the laser beam transmitted by the fiber optic cable comprises:

generating the laser beam at a surface of the wellbore; and transmitting the laser beam from the surface of the wellbore to the portion of the sandstone formation through the fiber optic cable.

13. A system for treating a formation using a laser, the system comprising:

a wellbore drilling assembly configured to drill a wellbore in a subterranean zone comprising a sandstone formation;

an additive material configured to reduce a melting point of the sandstone formation upon contacting a portion of the sandstone formation, wherein the additive material comprises potassium carbonate, calcium carbonate, potassium oxide, sodium carbonate, potassium nitrate, or any combination thereof;

flow equipment configured to flow the additive material through the wellbore to the portion of the sandstone formation, wherein the flow equipment comprises pumps; and a laser transmitter configured to be lowered into the wellbore, the laser transmitter configured to transmit a laser beam onto the portion of the sandstone formation, wherein the laser beam is configured to melt the portion of the sandstone formation at a reduced melting point responsive to the additive material contacting the portion of the sandstone formation.

14. The system of claim 13, further comprising a base fluid configured to carry the additive material through the wellbore to the portion of the sandstone formation.

15. The system of claim 14, wherein the base fluid comprises nitrogen, water, or a combination of nitrogen and water.

16. The system of claim 13, wherein the laser transmitter comprises a fiber optic cable run into the wellbore.

17. The system of claim 16, further comprising a laser assembly configured to generate the laser beam at a surface of the wellbore, wherein the fiber optic cable is connected to the laser assembly.

* * * * *